US005174767A

United States Patent [19]

Diekmann et al.

[11] Patent Number: 5,174,767

[45] Date of Patent: Dec. 29, 1992

[54] CONDUCTOR CONNECTOR ASSEMBLY

[75] Inventors: Joerg Diekmann, Bielefeld; Rainer Schulze, Detmold; Gerhard Huiskamp, Lage; Manfred Wilmes, Detmold, all of Fed. Rep. of Germany

[73] Assignee: C. A. Weidmueller GmbH & Co., Detmold, Fed. Rep. of Germany

[21] Appl. No.: 801,466

[22] Filed: Dec. 2, 1991

[30] Foreign Application Priority Data

Dec. 12, 1990 [DE] Fed. Rep. of Germany ..... 4039637

[51] Int. Cl.[5] ..... H01R 4/66

[52] U.S. Cl. ..... 439/94; 439/716

[58] Field of Search ..... 439/94, 717, 716

[56] References Cited

U.S. PATENT DOCUMENTS 4,269,471 5/1981 Woertz ..... 439/94

*Primary Examiner*—Eugene F. Desmond

*Attorney, Agent, or Firm*—Laubscher & Laubscher

[57] ABSTRACT

A conductor connector assembly for connecting a ground conductor or the like to a U-shaped top hat rail, including a first sheet metal member (1) arranged for seated engagement transversely across the outwardly directed flange portions at the free ends of the legs of the top hat rail, a second sheet metal member (2) adjacent the first member and including at each end a hook portion (16) adapted to extend below the associated flange portion, and a screw device (3) for displacing the second member upwardly relative to the first member, thereby to clamp the rail flange portions between the first and second sheet metal members. A guide arrangement is provided for guiding the members for vertical movement relative to each other.

9 Claims, 1 Drawing Sheet

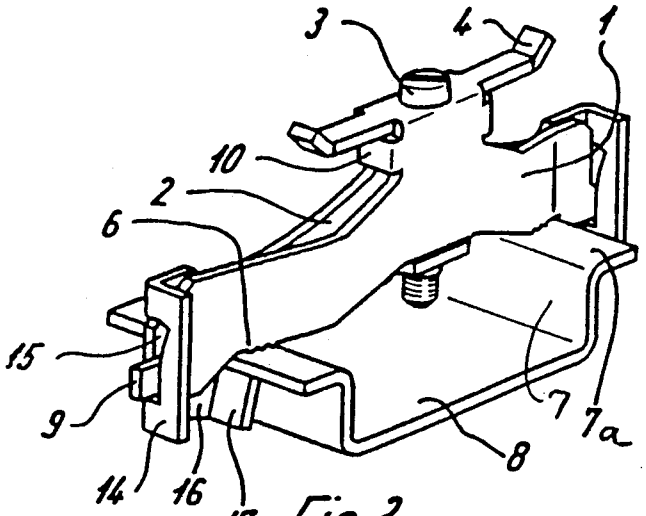
Fig. 3
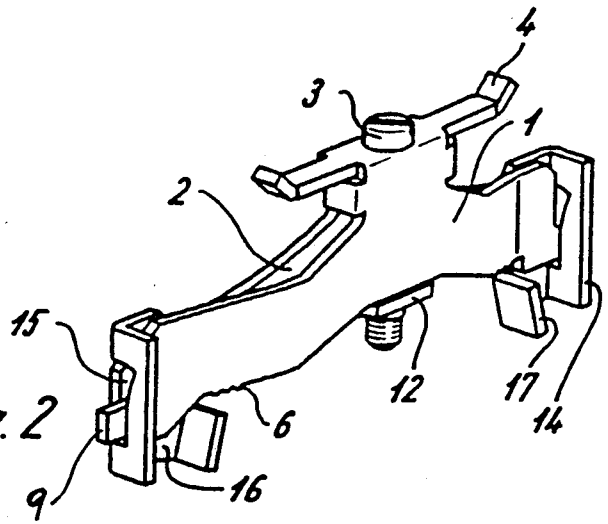
Fig. 2
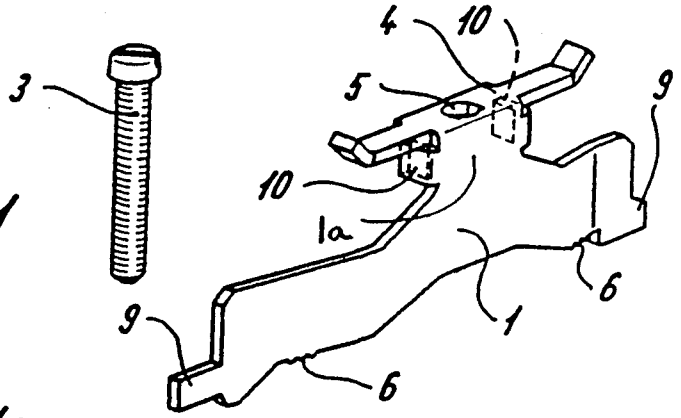
Fig. 1
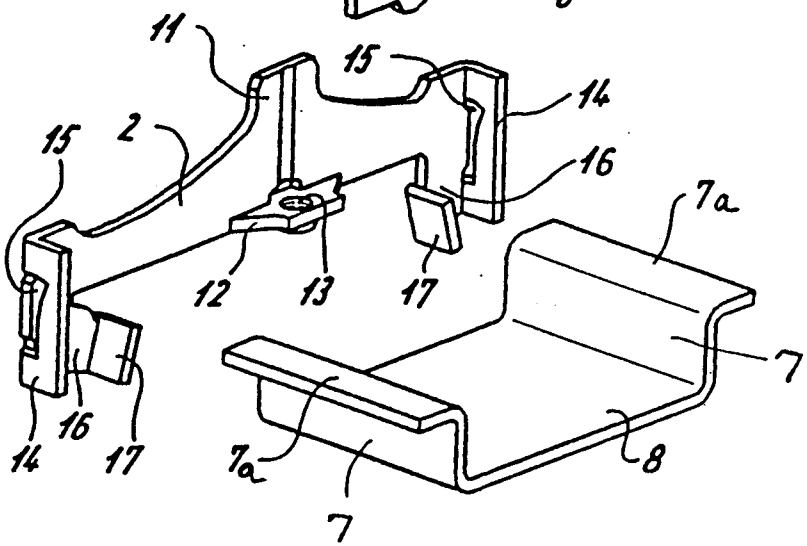

CONDUCTOR CONNECTOR ASSEMBLY

STATEMENT OF THE INVENTION

A conductor connector assembly is disclosed for connecting a ground conductor or the like to a U-shaped top hat rail, including a first sheet metal member adapted to be seated transversely across the outwardly extending horizontal flange portions at the upper ends of the vertical legs of the rail, a second sheet metal member adjacent said first member and including at its ends hook portions adapted to engage the lower surfaces of the rail flange portions, respectively, and screw means for displacing the members to clamp the flange portions therebetween.

BRIEF DESCRIPTION OF THE PRIOR ART

It is known in the prior art to provide conductor connecting means for connecting a grounded conduit to top hat rail which is at ground potential and which serves as a mounting rail. For example, in the German patent No. DE-GM 7726440, the bus bar piece and the counterlink are in each case made as a U-shaped, two-leg bent metal part, where, in the area above the top hat rail, the bus bar piece essentially lies above the counterlink that encloses the lower area of the bus bar piece, with its two legs, on both sides. With its lower terminal areas, the counterlink grasps the top hat rail legs in hook-fashion underneath. The counterlink is movable by means of a clamping screw with relation to the bus bar piece and can be clamped against the underside of the top hat rail legs.

The known design, to be sure, facilitates reliable mounting of the conductor connecter upon the top hat rail, but uses a relatively large amount of material, and this means that the bus bar and the counterlink are essentially arranged on top of each other, even if we consider the necessary mechanical strength, forming a relatively large overall structural height.

The purpose of the present invention therefore is to create a conductor connection having an appreciably lower height and which requires less material expenditure.

SUMMARY OF THE INVENTION

Accordingly, a primary object of the present invention is to provide a conductor connector that consists of a pair of sheet metal members arranged side-by-side with one member seated transversely across the top hat rail in engagement with the upper surfaces of the rail flange portions, and the other member having at its ends hook portions that extend beneath the flange portions, screw means being provided for vertically displacing said members relative to each other, whereby the flange portions are tightly clamped between the members.

Owing to the single-layer design of the bus bar piece and the counterlink of the present invention, the material required for this conductor connection is considerably reduced. This results in an extraordinarily low structural height because, in the area above the top hat rail, the single-layer bus bar piece and the single-layer counterlink are arranged in parallel side-by-side fashion.

This kind of design can also be constructed in such a mechanically stable fashion that one can ensure a secure mount on the top hat rail and the absorption of sufficiently large clamping forces.

According to a further object of the invention, in order to increase the stability of the connector with regard both to power absorption and the trouble-free clamping upon the top hat rail, guide means are provided for guiding the member for vertical displacement relative to each other. To this end, the first sheet metal member includes at each end projecting nose portions that extend within corresponding vertical guide slots contained in orthogonally bent wing portions of the second member. Moreover, the first member may be provided with a pair of orthogonally bent guide tabs between which a corresponding neck portion of the second member is guided.

BRIEF DESCRIPTION OF THE DRAWINGS

Other objects and advantages of the invention will become apparent from a study of the following specification, when viewed in the light of the accompanying drawings, in which:

FIG. 1 is an exploded view of the conductor connector of the present invention;

FIG. 2 is a perspective view of the assembled connector; and

FIG. 3 illustrates the conductor connector clamped to the top hat rail.

DETAILED DESCRIPTION

Referring first more particularly to FIG. 1, the conductor connector assembly includes first and second sheet metal members 1 and 2 that are connected for relative vertical movement by means of a clamping screw 3. The first member 1 includes intermediate its ends an upwardly extending neck portion 1*a* the upper end of which is bent orthogonally to define a first horizontal ledge portion 4 containing an oversized opening 5. On its lower edge, the member 1 includes a pair of roughened surfaces 6 that are adapted for seating engagement with the upper surfaces of outwardly extending flange portions 7*a* at the upper extremities of the legs 7 of a U-shaped top hat rail 8. At each end, the member 1 is provided with axially projecting nose portions 9. Furthermore, the neck portion 1*a* of member 1 is provided with a pair of parallel spaced ear portions 10 that are orthogonally bent from the upper neck portion 1*a*, thereby to support the first horizontal ledge portion 4.

The second sheet metal member 2 includes at each end a pair of orthogonally bent vertical wing portions 14 containing vertical slide guide slots 15 that receive the projecting nose portions 9 of the first member, respectively, as shown in FIGS. 2 and 3. Intermediate its ends, the lower edge of the second member is provided with an orthogonally bent second horizontal ledge portion 12 containing a threaded bore 13 opposite the oversize bore 5, whereby the threaded shank portion 3*b* of the screw 3 is inserted downwardly through the oversized bore 5 for threaded connection with the threaded bore 13 in the second ledge portion 12 of the second member 2. At each end, the second member 2 is provided with a hook portion 16 that extends beneath the associated flange portion 7*a* of the top hat rail 8. The hook portions 16 are strengthened by the orthogonally bent strengthening portion 17. When the components are in the assembled condition of FIG. 2, tightening of the screw 3 causes the second member 1 to be displaced vertically upwardly relative to the first member 1. During this upward movement, the second member is guided relative to the first member owing to the cooperation between the nose projections 9 and the vertical slots 15, and by the cooperation between the upwardly extending guide portion 11 intermediate the ends of the second member 2 and the cooperating guide ears 10 on the first member 1.

Referring to FIG. 3, when the first member is mounted transversely across the top hat rail 8 with the roughened lower surfaces 6 in seated engagement with the upper surfaces of the flange portion 7 of the top hat rail 8, the hook portions 16 with the strengthening tabs 17 extend beneath the surfaces of the horizontally outwardly directed flange portions *7a*. Consequently, when screw 3 is tightened by rotation, the second member 2 is displaced upwardly relative to the first member 1, thereby to tightly clamp the rail flange portions *7a* between the hook portions 16 of the second member 2 and the roughened surfaces 6 of the first member 1. It should be mentioned that the bent ear portions 10 support the first horizontal ledge portion 4 during the tightening of the screw 3 by a screw driver.

While in accordance with the provisions of the Patent Statutes the preferred embodiment and modifications of the invention have been illustrated and described, it will be apparent to those skilled in the art that changes may be made without deviating from the inventive concepts set forth above.

What is claimed is:

1. A conductor connector assembly operable to connect a ground conductor or the like to a generally U-shaped top hat rail (8) having a horizontal bridging portion and a pair of upstanding vertical leg portions (7) that terminate at their upper ends in laterally outwardly extending generally horizontal flange portions (*7a*), respectively, comprising:

(a) a first generally planar vertically arranged member (1) consisting solely of a single sheet metal layer and being adapted for horizontal placement above and transversely across said rail in seated engagement with the upper surfaces of said rail flange portions, respectively;

(b) a second generally planar vertically arranged member (2) consisting solely of a single sheet metal layer and being adapted to extend above and transversely across said rail adjacent, parallel with and in side-by-side relation relative to said first member, said second member including at each end a downwardly extending hook portion (16) adapted to engage the lower surface of the associated rail flange portion; and (c) means (3) for moving said second member upwardly relative to said first member, thereby to clamp said rail flange portions between said first and second members.

2. Apparatus as defined in claim 1, wherein said first and second members are in contiguous sliding engagement with each other.

3. Apparatus as defined in claim 1, and further wherein each of said hook portions includes at its free end a laterally bent orthogonally arranged strengthening tab portion (17).

4. Apparatus as defined in claim 1, and further including:

(d) guide means (9,15; 10,11) for guiding said members for vertical movement relative to each other.

5. A conductor connector assembly operable to connect a ground conductor or the like to a generally U-shaped top hat rail (8) having a horizontal bridging portion and a pair of upstanding vertical leg portions (7) that terminate at their upper ends in laterally outwardly extending generally horizontal flange portions (*7a*), respectively, comprising:

(a) a first generally planar vertically arranged sheet metal member (1) adapted for horizontal placement and above and transversely across said rail in seated engagement with the upper surfaces of said rail flange portions, respectively;

(b) a second generally planar vertically arranged sheet metal member (2) adapted to extend above and transversely across said rail adjacent said first member, said second member including at each end a downwardly extending hook portion (16) adapted to engage the lower surface of the associated rail flange portion; and (c) means (3) for moving said second member upwardly relative to said first member, thereby to clamp said rail flange portions between said first and second members;

(d) said second member including a pair of end portions having orthogonally bent wing portions (14) extending in parallel relation opposite each other, said wing portions containing opposed vertical guide slots (15), respectively, said first member including at its ends projecting portions (9) that extend within said guide slots, thereby to guide said members for vertical movement relative to each other.

6. Apparatus as defined in claim 5, wherein said first member includes intermediate its ends an intermediate neck portion (*1a*) having a pair of orthogonally bent vertical ear portions (10) extending in opposed parallel spaced relation relative to each other, said second member including an intermediate neck portion (11) that extends upwardly in slidably guided relation between said bent ear portions.

7. A conductor connector assembly operable to connect a ground conductor or the like to a generally U-shaped top hat rail (8) having a horizontal bridging portion and a pair of upstanding vertical leg portions (7) that terminate at their upper ends in laterally outwardly extending generally horizontal flange portions (*7a*), respectively, comprising:

(a) a first generally planar vertically arranged sheet metal member (1) adapted for horizontal placement and above and transversely across said rail in seated engagement with the upper surfaces of said rail flange portions, respectively;

(b) a second generally planar vertically arranged sheet metal member (2) adapted to extend above and transversely across said rail adjacent said first member, said second member including at each end a downwardly extending hook portion (16) adapted to engage the lower surface of the associated rail flange portion; and (c) means (3) for moving said second member upwardly relative to said first member, thereby to clamp said rail flange portions between said first and second members;

(d) said first member including intermediate its ends an upwardly extending intermediate neck portion which terminates at its upper end in an orthogonally bent first horizontal ledge portion (4).

8. Apparatus as defined in claim 7, wherein said intermediate neck portion of said first member includes a pair of orthogonally bent parallel spaced vertical support ear portions (10) upon which the lower surface of said first horizontal ledge portion is seated.

9. Apparatus as defined in claim 7, wherein said first horizontal ledge portion contains an oversized opening (5), and further wherein said second member includes adjacent its lower edge an orthogonally bent second horizontal ledge portion containing a threaded bore (13) opposite said oversized opening, said means for moving said second member relative to said first member including a screw member (3) having a head portion (3*a*) seated upon the upper surface of said first horizontal ledge portion, said screw member having a threaded shank portion (3*b*) that extends downwardly through said oversized opening, said screw member being in threaded engagement at its lower end with said threaded bore.

* * * * *